US008070152B2

(12) United States Patent
Miwa et al.

(10) Patent No.: US 8,070,152 B2
(45) Date of Patent: Dec. 6, 2011

(54) SHEET SUPPLYING UNIT AND IMAGE FORMING DEVICE

(75) Inventors: Atsushi Miwa, Nagoya (JP); Makoto Hattori, Nagoya (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 208 days.

(21) Appl. No.: 12/492,761

(22) Filed: Jun. 26, 2009

(65) Prior Publication Data

US 2010/0001455 A1 Jan. 7, 2010

(30) Foreign Application Priority Data

Jul. 1, 2008 (JP) ..... 2008-172071

(51) Int. Cl.
*B65H 5/00* (2006.01)

(52) U.S. Cl. ..... 271/10.03; 271/4.03; 271/266; 271/256; 271/258.01; 271/258.03; 271/258.02

(58) Field of Classification Search ..... 271/4.03, 271/10.03, 256, 258.01, 258.02, 258.03, 271/266

See application file for complete search history.

(56) References Cited

U.S. PATENT DOCUMENTS

| | | | | |
|---|---|---|---|---|
| 6,685,184 | B2 * | 2/2004 | Tufekci et al. | 271/270 |
| 7,068,969 | B2 * | 6/2006 | Ueda | 399/388 |
| 7,296,794 | B2 * | 11/2007 | Shimazaki | 271/259 |
| 7,393,075 | B2 | 7/2008 | Horiuchi | |
| 7,775,519 | B2 * | 8/2010 | Takahashi et al. | 271/258.01 |
| 7,871,068 | B2 * | 1/2011 | Yamazaki | 271/10.03 |
| 2003/0168798 | A1 * | 9/2003 | Tufekci et al. | 271/258.01 |
| 2005/0179197 | A1 * | 8/2005 | Able et al. | 271/258.01 |
| 2005/0184443 | A1 * | 8/2005 | Satoh et al. | 271/10.01 |
| 2006/0180978 | A1 * | 8/2006 | Aoki et al. | 271/10.01 |
| 2008/0063449 | A1 | 3/2008 | Fukasawa et al. | |

(Continued)

FOREIGN PATENT DOCUMENTS

| | | |
|---|---|---|
| JP | 5-58481 | 3/1993 |

(Continued)

*Primary Examiner* — Stefanos Karmis
*Assistant Examiner* — Howard Sanders
(74) *Attorney, Agent, or Firm* — Scully, Scott, Murphy & Presser, PC

(57) ABSTRACT

A sheet supplying unit that supplies sheets includes a sheet accommodation tray that accommodates the sheets in a stacked state, the sheets including a first sheet which is an uppermost sheet in the stack of the sheets and a second sheet which is immediately below the first sheet; a pick-up roller that conveys the sheets in a sheet conveying direction; a detection sensor that detects passage of the sheets and is disposed downstream of the pick-up roller in the sheet conveying direction; and a control unit that controls operations of the pick-up roller in accordance with outputs from the detection sensor. The control unit includes a driving section that drives the pick-up roller to start conveying the second sheet when the detection sensor detects a trailing edge of the first sheet, if the second sheet is to be fed; a suspending section that temporarily stops driving the pick-up roller for a time period $\alpha$-$\beta$ when the detection sensor detects a leading edge of the second sheet, $\alpha$ being a predetermined time period, and $\beta$ being a time period from a timing when the detection sensor detects the trailing edge of the first sheet to a timing when the detection sensor detects the leading edge of the second sheet; and a resuming section that resumes driving the pick-up roller to convey the second sheet after suspending for the time period $\alpha$-$\beta$.

11 Claims, 7 Drawing Sheets

U.S. PATENT DOCUMENTS

| | | | | |
|---|---|---|---|---|
| 2009/0039594 | A1* | 2/2009 | Sato et al. | 271/258.01 |

FOREIGN PATENT DOCUMENTS

| | | |
|---|---|---|
| JP | 5-201557 | 8/1993 |
| JP | 9-314936 | 12/1997 |
| JP | 2000-159392 | 6/2000 |
| JP | 2000-284556 | 10/2000 |
| JP | 2005-96450 | 4/2005 |
| JP | 2008-56444 | 3/2008 |

* cited by examiner

SHEET SUPPLYING UNIT AND IMAGE FORMING DEVICE

CROSS REFERENCE TO RELATED APPLICATION

This application claims priority from Japanese Patent Application No. 2008-172071 filed Jul. 1, 2008. The entire content of the priority application is hereby incorporated by reference in its entirety.

TECHNICAL FIELD

The present invention relates to a sheet supplying unit, and also to an image forming device provided with the sheet supplying unit.

BACKGROUND

In a conventional image forming device which performs printing or processing operations on sheets, such sheets are accommodated in a sheet accommodation tray in a stacked state and are picked up one sheet at a time when supplied. One of conventional sheet supplying units includes a pivotally movable arm portion and a pick-up roller provided at a free end of the arm portion. The pick-up roller contacts sheets stacked in a sheet accommodation tray and picks up each sheet while rotating. In this sheet supplying unit, when the sheets within the sheet accommodation tray become fewer, the pick-up roller is configured to pivotally move downward to pick up each sheet.

However, in this sheet supplying unit, heights of uppermost sheets in the sheet accommodation tray change depending on how many sheets are left therein. Therefore, a time period until when a leading edge of each sheet reaches a prescribed position in a sheet conveying path from when each sheet is picked up also varies in accordance with amounts of sheets left in the sheet accommodation tray. That is, conveyance distance is practically longer when fewer sheets are left, thus requiring longer time. Note that, the prescribed position in the sheet conveying path is assumed to be such a position that a detection sensor for detecting passage of sheets is provided. When a plurality of sheets is sequentially conveyed, since a predetermined time interval is necessary to be interposed between two consecutive sheets, the sheet supplying unit is required to start feeding subsequent sheet when the detection sensor detects a trailing edge of a precedent sheet. Therefore, when a trailing edge of a sheet is detected to have passed, a prescribed period of stand-by time has been conventionally established before a new sheet is supplied.

Since the conveyance distance up to the detection sensor varies according to amounts of sheets in the sheet accommodation tray, time intervals between each sheet inevitably change when a plurality of sheets needs to be supplied consecutively. Thus, how many sheets are supplied in a certain time period consequently varies. As a result, sheet feeding capability cannot be fully utilized in such a conventional sheet supplying unit.

Another type of conventional sheet supplying units has proposed a movable pressure plate provided on a bottom surface of a sheet accommodation tray. The pressure plate is configured to be movable in a vertical direction so that sheets stacked in the sheet accommodation tray are urged upward and a pick-up roller can therefore pick up an uppermost sheet at a constant position.

This sheet supplying unit appears to obviate the drawbacks described earlier. However, the sheets below an uppermost sheet tend to be slightly displaced when the pick-up roller picks up the uppermost sheet Hence, positions of uppermost sheets thus slightly vary time to time within the sheet accommodation tray. As a consequence, considering such positional variations of sheets, a longer time interval is necessary to be set in order to secure a predetermined time interval between consecutively supplied sheets at the time of sheet supply.

SUMMARY

In view of the foregoing, it is an object to the present invention to provide a sheet supplying unit and an image forming device, with improved efficiency in sheet supply, capable of supplying sheets at a minimum time interval, regardless of deviations in positions of sheets in the sheets accommodation tray.

In order to achieve the above and other objects, the present invention provides a sheet supplying unit that supplies sheets. The sheet supplying unit includes a sheet accommodation tray that accommodates the sheets in a stacked state, the sheets including a first sheet which is an uppermost sheet in the stack of the sheets and a second sheet which is immediately below the first sheet; a pick-up roller that conveys the sheets in a sheet conveying direction; a detection sensor that detects passage of the sheets and is disposed downstream of the pick-up roller in the sheet conveying direction; and a control unit that controls operations of the pick-up roller in accordance with outputs from the detection sensor. The control unit includes a driving section that drives the pick-up roller to start conveying the second sheet when the detection sensor detects a trailing edge of the first sheet, if the second sheet is to be fed; a suspending section that temporarily stops driving the pick-up roller for a time period $\alpha$-$\beta$ when the detection sensor detects a leading edge of the second sheet, $\alpha$ being a predetermined time period, and $\beta$ being a time period from a timing when the detection sensor detects the trailing edge of the first sheet to a timing when the detection sensor detects the leading edge of the second sheet; and a resuming section that resumes driving the pick-up roller to convey the second sheet after suspending for the time period $\alpha$-$\beta$.

According to an aspect of the present invention, there is provided an image forming device including an image forming unit that forms images on sheets, and a sheet supplying unit that supplies the sheets to the image forming unit. The sheet supplying unit includes a sheet supplying unit that supplies the sheets to the image forming unit, a pick-up roller that conveys the sheets to the image forming unit in a sheet conveying direction, a detection sensor that detects passage of the sheets and is disposed downstream of the pick-up roller in the sheet conveying direction, and a control unit that controls operations of the pick-up roller in accordance with outputs from the detection sensor. The control unit includes a driving section that drives the pick-up roller to start conveying the second sheet when the detection sensor detects a trailing edge of the first sheet, if the second sheet is to be fed; a suspending section that temporarily stops driving the pick-up roller for a time period $\alpha$-$\beta$ when the detection sensor detects a leading edge of the second sheet, $\alpha$ being a predetermined time period, and $\beta$ being a time period from a timing when the detection sensor detects the trailing edge of the first sheet to a timing when the detection sensor detects the leading edge of the second sheet; and a resuming section that resumes driving the pick-up roller to convey the second sheet after suspending for the time period $\alpha$-$\beta$.

According to another aspect of the present invention, there is provided a method of supplying sheets in a sheet supplying unit. The sheet supplying unit includes a sheet accommodation tray that accommodates the sheets in a stacked state, the sheets including a first sheet which is an uppermost sheet in the stack of the sheets and a second sheet which is immediately below the first sheet; a pick-up roller that conveys the sheets in a sheet conveying direction; and a detection sensor that detects passage of the sheets and is disposed downstream of the pick-up roller in the sheet conveying direction. The method includes driving the pick-up roller to start feeding the first sheet; driving the pick-up roller to convey the second sheet when the detection sensor detects a trailing edge of the first sheet, if the second sheet is to be fed; suspending driving the pick-up roller for a time period $\alpha$-$\beta$ when the detection sensor detects a leading edge of the second sheet, $\alpha$ being a predetermined time period, and $\beta$ being a time period from a timing when the detection sensor detects the trailing edge of the first sheet to a timing when the detection sensor detects the leading edge of the second sheet; and resuming driving the pick-up roller to convey the second sheet after suspending for the time period $\alpha$-$\beta$.

DETAILED DESCRIPTION

An embodiment of the present invention will now be described with reference to FIGS. 1 through 6D.

First, a general configuration of a laser printer 1 provided with a sheet supplying unit according to the present embodiment will be described while referring to FIGS. 1 to 3. Note that, in the following description, right side in FIG. 1 is designated as a "front side", while left side is designated as a "rear side".

Figure 1:
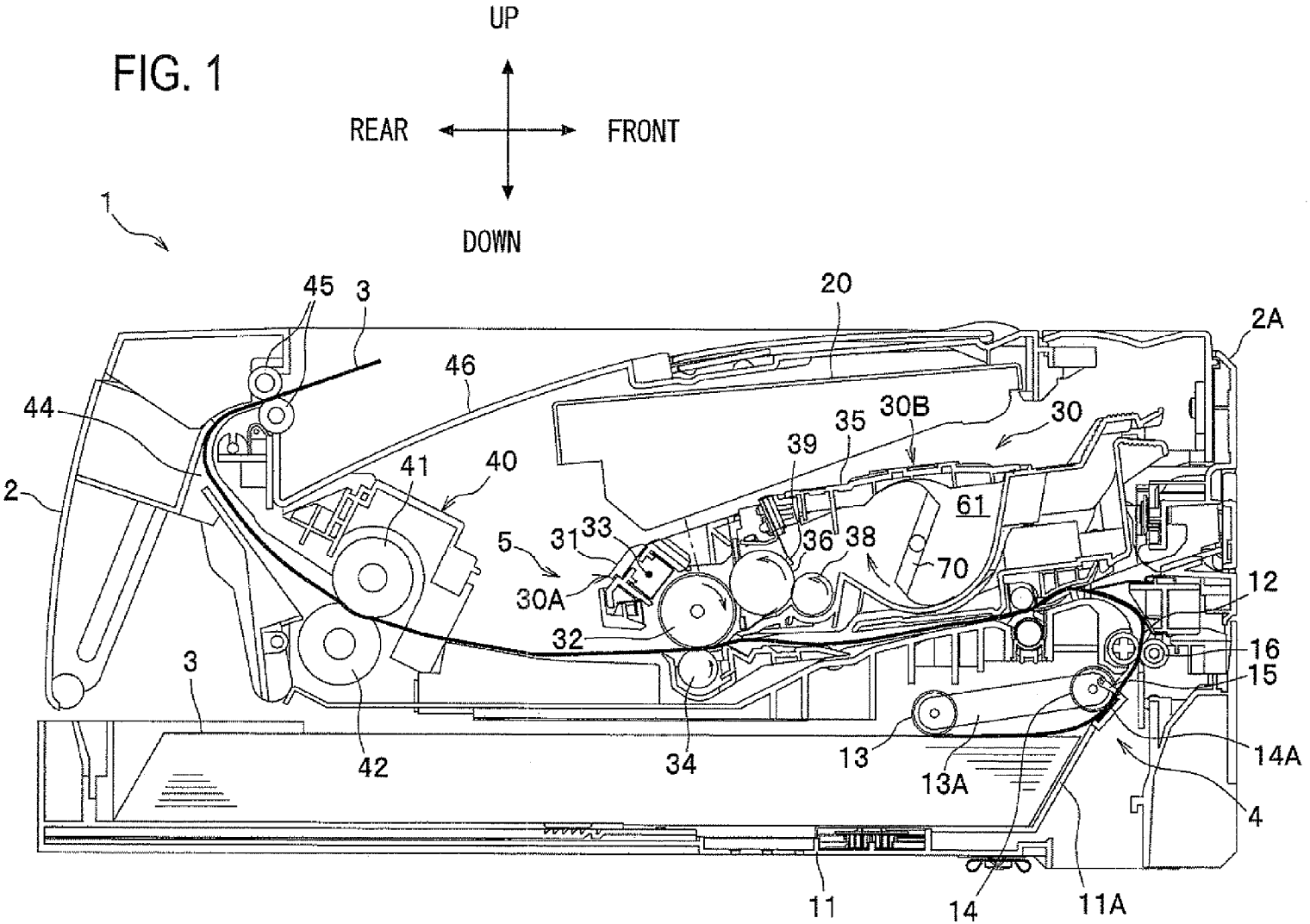
FIG. 1 is a cross-sectional view of an essential portion of a laser printer provided with a sheet supplying unit according to an embodiment of the present invention.

As shown in FIG. 1, the laser printer 1, an example of an image forming device of the present embodiment, includes a main casing 2, an image forming unit 5 and a sheet supplying unit 4 that supplies paper 3 (an example of sheets) to the image forming unit 5.

The main casing 2 has a front opening, and a front cover 2A is pivotably movably connected to the main casing 2 for covering the front opening. A process cartridge 30 is detachably mountable in the main casing 2 through the front opening when the front cover 2A is opened.

The sheet supplying unit 4 includes a sheet tray 11, a pick-up roller 13, a separation roller 14, a detection sensor 15, a conveyer roller 16 and a control unit 100. The control unit 100 is conceptually shown in FIG. 4, but not illustrated in FIGS. 1 and 2.

The sheet tray 11 is an example of sheet accommodation trays and accommodates a stack of paper 3. The sheet tray 11 is detachably mountable in the main casing 2. The sheet tray 11 has a side wall at a front side thereof (to be referred to as front side wall 11A) which extends diagonally upward and frontward. When the pick-up roller 13 picks up the paper 3 and conveys the same forward, the paper 3 collides against the front side wall 11A and is then urged upward to reach a sheet conveying path 12 extending from the front side wall 11A.

The pick-up roller 13 is adapted to convey the paper 3 from the sheet tray 11 to the sheet conveying path 12 extending toward the image forming unit 5. A roller supporting arm 13A is provided in the main casing 2 so as to be pivotably movable in a vertical direction about a rotational shaft of the separation roller 14. The pick-up roller 13 is disposed at a free end (i.e., rear end in FIG. 1) of the roller supporting arm 13A and is driven to rotate following a rotation of the separation roller 14 via an endless belt or a gear (not shown).

Note that the roller supporting arm 13A is biased downward by a spring (not shown) or a driving force inputted to the separation roller 14 so that the pick-up roller 13 is brought into contact with an uppermost sheet of the stacked paper 3 under a suitable pressure. Hence, when the paper 3 is fully accommodated in the sheet tray 11, the pick-up roller 13 is in contact with the uppermost sheet of the fully accommodated paper 3 as shown in FIG. 1. At this time, the free end of the roller supporting arm 13A is located at a position upward in the sheet tray 11. When the paper 3 has decreased, on the other hand, the pick-up roller 13 contacts the uppermost sheet of the reduced paper 3, as shown in FIG. 2. At this time, the free end of roller supporting arm 13A is at a lower position within the sheet tray 11. In this way, the pick-up roller 13 moves down to levels necessary to pick up the paper 3 in accordance with amounts of the paper 3 left in the sheet tray 11. As a result, distance between a leading edge of a sheet in the sheet tray 11 and the separation roller 14 varies depending on amounts of the paper 3 in the sheet tray 11. That is, paper conveying distance changes one after another.

The separation roller 14 is disposed above the front side wall 11A. The separation roller 14 is driven to rotate when inputted a driving force from a motor (not shown) under control of the control unit 100. A separation pad 14A is provided at a position diagonally downward front of the separation roller 14 and diagonally upward front of the front side wall 11A. After conveyed by the pick-up roller 13, the paper 3 is separated one by one when nipped between the separation roller 14 and the separation pad 14A, and then conveyed to the sheet conveying path 12.

The detection sensor 15 is disposed at a position adjacent to the separation roller 14 but downstream of the separation roller 14 in the sheet conveying path 12. The detection sensor 15 is a conventional sensor that detects passage of the paper 3. Specifically, as shown in FIG. 3, the detection sensor 15 includes an arm 15A pivotally movable about a rotational axis 15B, and an optical sensor 15E. The optical sensor 15E includes a light emitting element 15F that emits light and a light receiving element 15G that receives the light emitted from the light emitting element 15F. The arm 15A includes a sheet contact arm 15C and a light shielding arm 15D. The sheet contact arm 15C comes into direct contact with each paper 3. The light shielding arm 15D extends from the sheet contact arm 15C toward the optical sensor 15E. The light shielding arm 15D is pivotally movable about the rotational axis 15B and can be positioned between the light emitting element 15F and the light receiving element 15G. The arm 15A is normally biased by a spring (not shown) so that the light shielding arm 15D can block the light of the optical sensor 15E. However, upon pivotal movement of the sheet contact arm 15C when the paper 3 pushes the sheet contact arm 15C, light detecting phase of the optical sensor 15E can be changed, thereby detecting sheet passage through the detection sensor 15. More specifically, passage of the leading edge of the paper 3 is detected by the change from light shielding phase to the light transmission phase, and passage of the trailing edge of the paper 3 is detected by the change from the light transmission phase to the light shielding phase. Note that, the optical sensor 15E may also be configured such that the light is not blocked during no passage of the paper 3, and that the light is shielded when the paper 3 passes through the detection sensor 15.

The conveyer roller 16 is disposed downstream of detection sensor 15 in the sheet conveying path 12. The conveyer roller 16 conveys the paper 3 that has passed the detection sensor 15 to the image forming unit 5.

The control unit 100 controls operations of the pick-up roller 13, the separation roller 14 and the conveyer roller 16 in accordance with outputs of the detection sensor 15. Details of the control will be described later.

The image forming unit 5 includes a scanner 20, the process cartridge 30 and a fixing unit 40. The scanner 20 is provided in an upper portion of the main casing 2, and includes a laser emitting section (not shown). A laser beam emitted from the laser emitting section is irradiated onto a surface of a photosensitive drum 32 (to be described next) in the process cartridge 30 at a high speed, as shown by a single dot chain line in FIG. 1.

The process cartridge 30 is disposed below the scanner 20, and is detachably mounted in the main casing 2. The process cartridge 30 includes a photosensitive cartridge 30A supporting the photosensitive drum 32 and a developer cartridge 30B accommodating toner therein.

The photosensitive cartridge 30A includes a drum frame 31 constituting an outer frame of the photosensitive cartridge 30A, and the photosensitive drum 32, a Scorotron charger 33 and a transfer roller 34 are provided within the drum frame 31.

The developer cartridge 30B includes a developer case 35 forming a developer accommodation chamber 61, a develop roller 36, a supply roller 38, a thickness-regulation blade 39 and an agitator 70. Of these, the develop roller 36, the supply roller 38 and the agitator 70 are rotatably supported to the developer case 35. In accordance with rotation of the supply roller 38 in a direction of an arrow (i.e., counterclockwise), toner accommodated in the developer case 35 is supplied to the develop roller 36. At this time, the toner is positively tribocharged between the supply roller 38 and the develop roller 36. The toner borne on the develop roller 36 then enters between the develop roller 36 and the thickness-regulation blade 39 while the develop roller 36 rotates in a direction of an arrow (counterclockwise), thereby being maintained on the surface of the develop roller 36 as a thin layer of uniform thickness.

The photosensitive drum 32 is rotatably supported to the drum frame 31 connected to the developer cartridge 30B so as to rotate in a direction of an arrow (i.e., clockwise). The photosensitive drum 32 is made up of a drum body grounded and a photosensitive layer made of a positively chargeable material. The photosensitive layer is formed over the drum body.

The Scorotron charger 33 is disposed above and in opposition to the photosensitive drum 32 with a prescribed space interposed therebetween. The Scorotron charger 33 generates a corona discharge from a charging wire (tungsten, for example) and charges the surface of the photosensitive drum 32 with a uniform positive polarity.

The transfer roller 34 is disposed below and in opposition to the photosensitive drum 32. The transfer roller 34 is in contact with the photosensitive drum 32 and supported to the drum frame 31 so as to be rotatable in a direction of an arrow (i.e., counterclockwise). The transfer roller 34 is made up of a metal roller shaft covered with a conductive rubber material. A transfer bias is applied to the transfer roller 34 under constant current control at the time of transferring operations.

After uniformly positively charged by the Scorotron charger 33, the surface of the photosensitive drum 32 is exposed to light by the high speed scanning of the laser beam from the scanner 20. In this way, exposed areas have a lower potential, thereby forming an electrostatic latent image based on the image data. Here, "electrostatic latent image" means an exposed portion on the surface of the photosensitive drum 32 charged with a positive uniform polarity, and having a lower potential because of the exposure to the laser beam.

Following the rotation of the develop roller 36, the toner borne on the surface of the develop roller 36 is supplied to the electrostatic latent image formed on the surface of the photosensitive drum 32 when the develop roller 36 comes into contact with the photosensitive drum 32. Thus the latent image on the photosensitive drum 32 is developed into a visible toner image according to a reverse development process.

Subsequently, the photosensitive drum 32 and the transfer roller 34 are driven to rotate so as to nip the paper 3 therebetween. At this time, when the paper 3 passes between the photosensitive drum 32 and the transfer roller 34, the toner image carried on the surface of the photosensitive drum 32 is transferred onto the surface of the paper 3.

The fixing unit 40 is disposed downstream of the process cartridge 30 in the sheet conveying path 12. The fixing unit 40 includes a heat roller 41 and a pressure roller 42 disposed in opposition to the heat roller 41 so that the paper 3 can be nipped therebetween. In the fixing unit 40, the toner transferred on the paper 3 is thermally fixed while the paper 3 passes between the heat roller 41 and the pressure roller 42. The paper 3 is then conveyed toward a pair of discharge rollers 45 along a discharge path 44, and the discharge rollers 45 finally discharge the paper 3 onto a discharge tray 46.

Next, configurations and operations of the control unit 100 will be described in greater detail with reference to FIGS. 4 through 6D.

Figure 4:
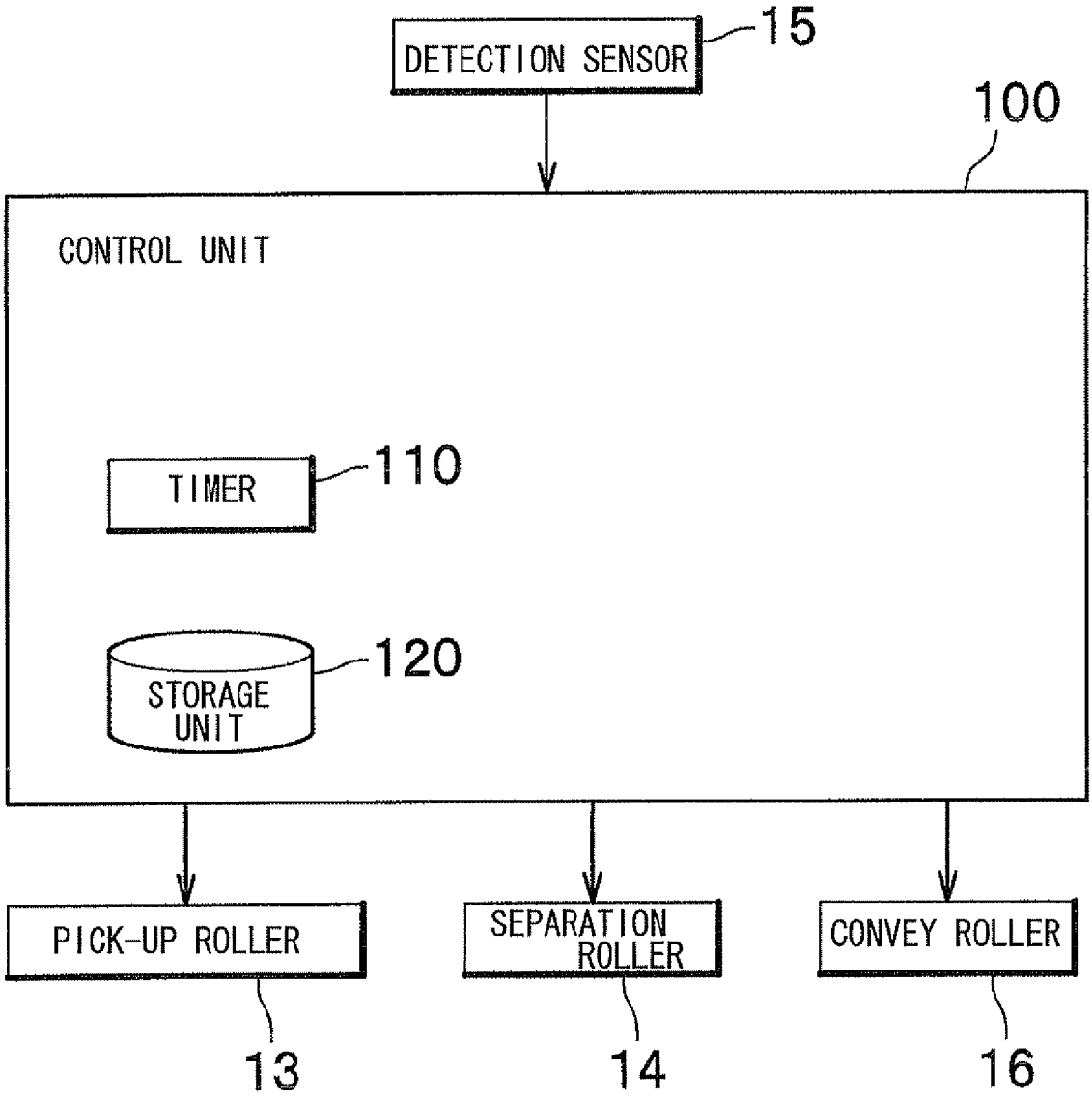
FIG. 4 is a block diagram of a control unit in the laser printer according to the present embodiment.

As shown in FIG. 4, the control unit 100 includes a timer 110 that measures time, and a storage unit 120 that stores programs and data. The control unit 100 controls operations of (drives or stops) the pick-up roller 13, the separation roller 14 and the conveyer roller 16 in accordance with detection results inputted from the detection sensor 15. The control unit 100 includes well-known hardware such as a CPU, a ROM and a RAM, and executes programs stored in the storage unit 120 when appropriate so that the control unit 100 can have control over each roller. Specifically, the control unit 100 determines whether to operate or stop the pick-up roller 13, the separation roller 14 and the conveyer roller 16 respectively according to the results detected by the detection sensor 15, and controls each drive control section (not shown) to output an electric power to drive each roller. Note that the control unit 100 stores various calculation results or the like in the storage unit 120 during the processing, but the description thereof will be omitted.

Also note that in the present embodiment, the pick-up roller 13 moves in conjunction with the operations of the separation roller 14. Hence, the control unit 100 only determines whether or not the separation roller 14 is operating, and drives the separation roller 14 whenever necessary. In other words, the control unit 100 controls the operations of the pick-up roller 13 via the separation roller 14. As to operations and controls of the conveyer roller 16, detailed descriptions therefor will also be omitted.

Figure 5:
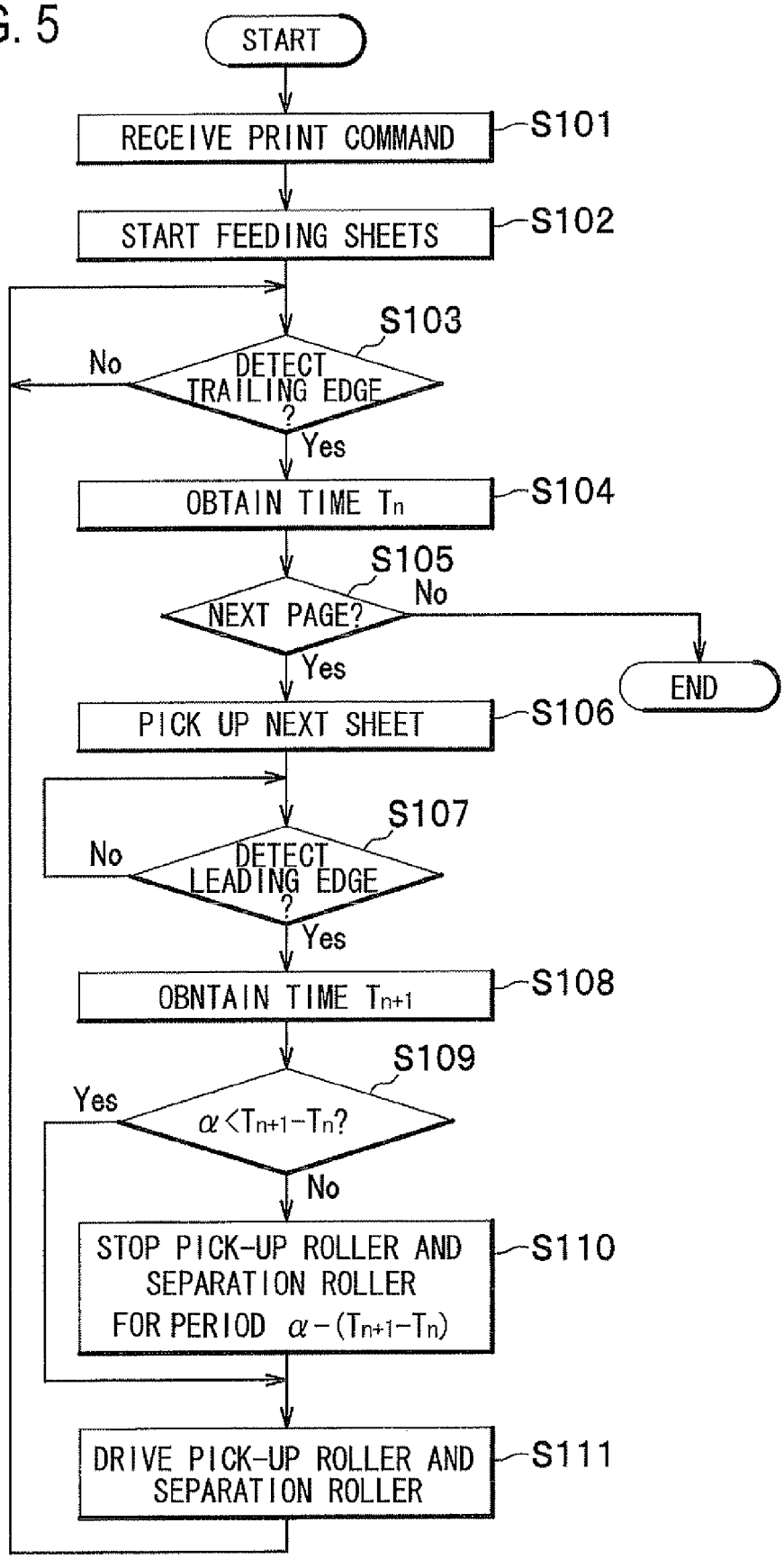
FIG. 5 is a flowchart of sheet supply control routine executed by the control unit in the laser printer according to the present embodiment.

Control routine for controlling each roller in response to outputs from the detection sensor 15 is first described while referring to the flowchart of FIG. 5.

When a command indicative of execution of a printing operation is transmitted to the laser printer 1 from a PC, the control unit 100 receives the print command (S101). Note that the print command here corresponds to a command to feed sheets in terms of the sheet supplying unit 4. Upon receiving the print command, the control unit 100 drives the pick-up roller 13 and the separation roller 14 to start feeding a first sheet (of the paper 3) accommodated in the sheet tray 11 (S102). Here, also note that, although not shown in FIG. 5, when the paper 3 has been conveyed to the sheet conveying path 12 and the conveyer roller 16 has started conveying the paper 3, operations of the pick-up roller 13 and the separation roller 14 are configured to stop at an appropriate timing.

Subsequently, the control unit 100 continues to drive the conveyer roller 16 until the detection sensor 15 detects a trailing edge of the first sheet (S103:No). When the detection sensor 15 detects the trailing edge of the first sheet (S103: Yes), the control unit 100 obtains a time $T_n$ from the timer 110 (S104).

The control unit 100 then determines whether or not the print command includes a next page to be printed (S105). If there is no more page to be printed (S105:No), the control unit 100 stops feeding sheets. If there is a next page to be printed (S105:Yes), the control unit 100 drives the pick-up roller 13 and the separation roller 14 to start picking up a second sheet (next sheet of the paper 3) (S106). The picking-up operation continues for a prescribed period of time until the detection sensor 15 detects a leading edge of the second sheet (S107: No). When the detection sensor 15 detects the leading edge of the second sheet (S107:Yes), the control unit 100 obtains a time $T_{n+1}$ from the timer 110 (S108). The control unit 100 then retrieves a predetermined value $\alpha$ from the storage unit 120 and makes comparison between $T_{n+1}-T_n(=\beta)$ and $\alpha$ (S109).

If $\alpha$ is greater than $T_{n+1}-T_n$ (S109:No), the control unit 100 stops driving the pick-up roller 13 and the separation roller 14 for a period of time $\alpha-(T_{n+1}-T_n)$, i.e., $\alpha-\beta$ (S110). After suspending operations of the pick-up roller 13 and the separation roller 14 for the prescribed period of time $\alpha-\beta$, the control unit 100 drives the pick-up roller 13 and the separation roller 14 to resume supply of the paper 3 (S111). Although not shown in FIG. 5, the control unit 100 stops driving the pick-up roller 13 and the separation roller 14 at an appropriate timing after the conveyer roller 16 has received the second sheet and has started conveying the same.

On the other hand, if $\alpha$ is smaller than $T_{n+1}-T_n$ (S109:Yes), the control unit 100 continues to drive the pick-up roller 13 and the separation roller 14 without suspension (S111). Subsequently, the control unit 100 moves back to S103 and continues the above-described processing until no more pages exist in the print command (S105).

Next, operation time and duration of the pick-up roller 13 and the separation roller 14 in the above-described processing will be described with reference to time charts of FIGS. 6A through 6D.

Note that, in FIGS. 6A to 6D, 'D' represents a state where the detection sensor 15 detects the paper (DETECTION), while 'ND' stands for a state where the detection sensor 15 does not detect the paper 3 (NON-DETECTION). For example, in FIG. 6A, the detection sensor 15 detects a trailing edge of a precedent sheet at time t1, and a leading edge of a subsequent sheet at time t6.

Figure 6A:
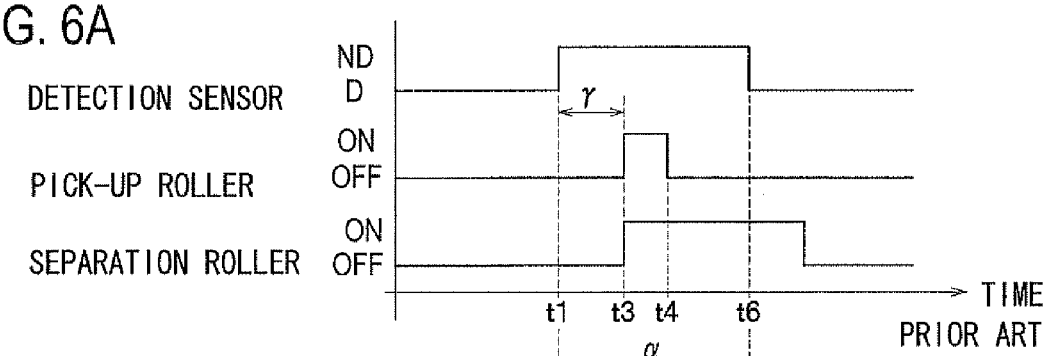
FIG. 6A is a time chart showing operational states of a detection sensor, a pick-up roller and a separation roller in a conventional laser printer.

First, operations of the pick-up roller 13 and the separation roller 14 in a conventional sheet supplying unit are described in order to fully understand the present invention. As shown in FIG. 6A representing prior arts, conventionally, the pick-up roller 13 is driven to pick up the subsequent sheet at t3 when a prescribed period of time $\gamma$ has passed since the detection sensor 15 detected a trailing edge of the precedent sheet at t1. The subsequent sheet is then continued to be conveyed because the separation roller 14 is driven to rotate longer than the pick-up roller 13. Therefore, when the paper 3 in the sheet tray 11 is running out, the conveyance distance of each uppermost sheet from the sheet tray 11 to the detection sensor 15 becomes gradually greater. Hence, when sheets are supplied consecutively, time intervals between each sheet vary time to time depending on amounts of the paper 3 left in the sheet tray 11.

Figure 6B:
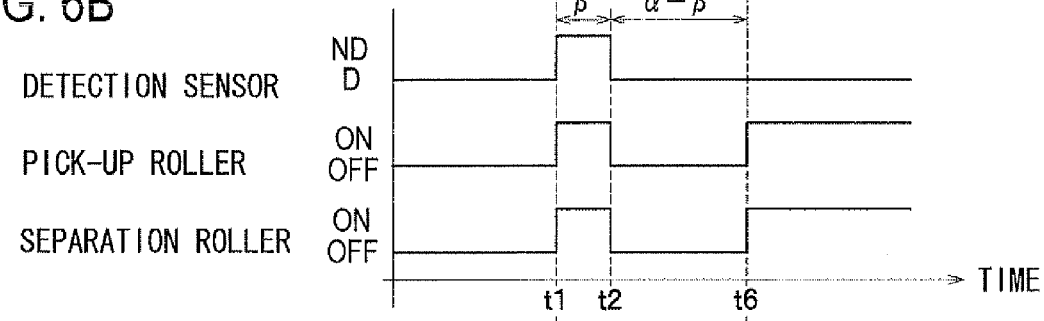
PRIOR ART FIG. 6B
FIG. 6B is a time chart showing operational states of the detection sensor, a pick-up roller and a separation roller when sheets are fully accommodated in the laser printer according to the present embodiment.

In the sheet supplying unit 4 according to the present embodiment and the laser printer 1 provided with the sheet supplying unit 4, the pick-up roller 13 and the separation roller 14 are configured to operate as shown in FIG. 6B. In this case, when the paper 3 is fully accommodated in the sheet tray 11. Specifically, the pick-up roller 13 is driven to rotate simultaneously when the detection sensor 15 detects a trailing edge of the precedent sheet (paper 3) at t1. In this way, the pick-up roller 13 can start picking up the subsequent sheet (paper 3) as early as possible. When the detection sensor 15 detects a leading edge of subsequent sheet of paper 3 at t2, the pick-up roller 13 and the separation roller 14 stop driving for the period of time $\alpha-\beta$ from t2 to t6. After the interruption, the pick-up roller 13 and the separation roller 14 resume operating at t6 and continue to convey the paper 3. As apparent from FIG. 6B, the time interval between each successively conveyed sheet thus becomes constant, i.e., $\alpha$.

Figure 2:
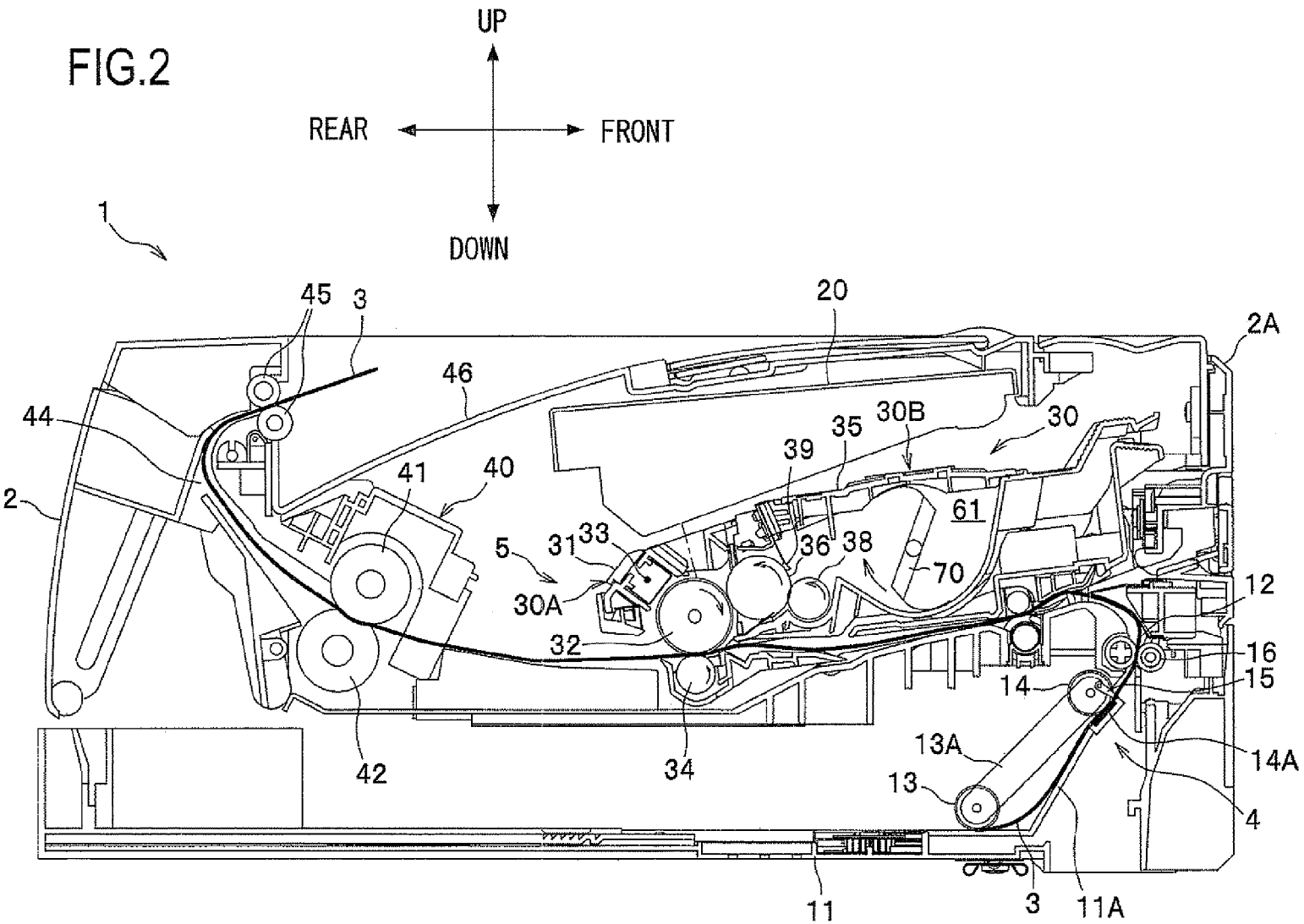
FIG. 2 is a cross-sectional view of the essential portion of the laser printer when sheets of paper accommodated in a sheet tray become fewer.
Figure 3:
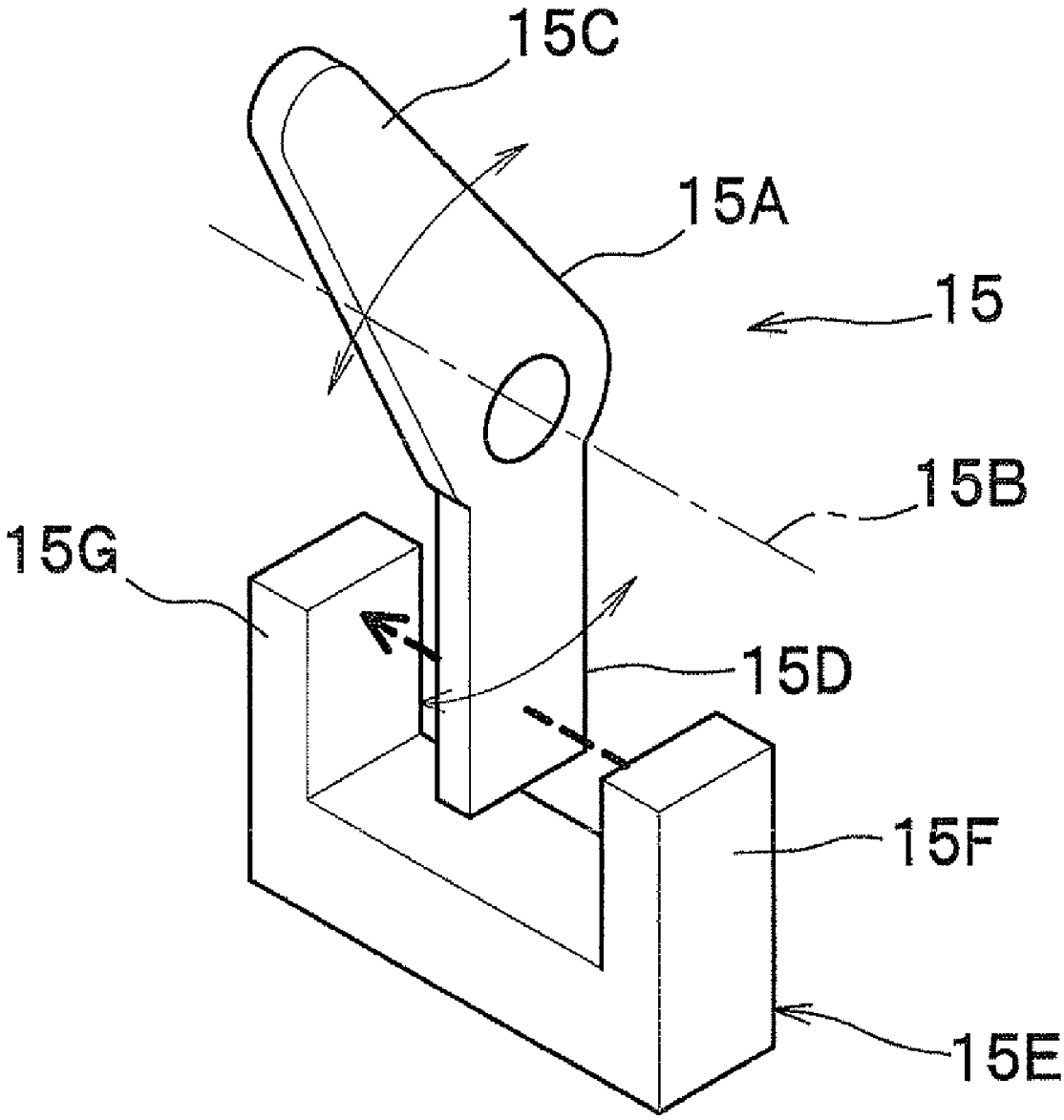
FIG. 3 is a perspective view of a detection sensor in the sheet supplying unit according to the present embodiment.
Figure 6C:
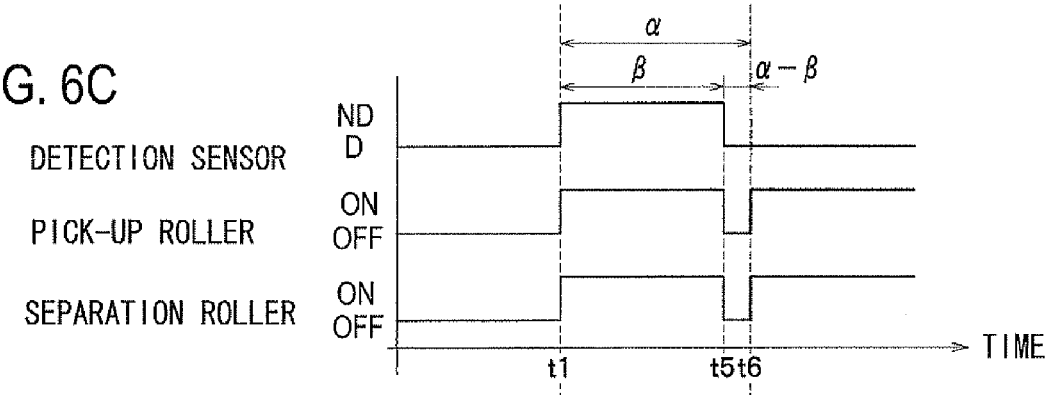
FIG. 6C is a time chart showing operational states of the detection sensor, the pick-up roller and the separation roller when fewer sheets are left in the laser printer according to the present embodiment.

When the paper 3 in the sheet tray 11 becomes smaller in amount, the distance for each uppermost sheet accommodated in the sheet tray 11 up to the detection sensor 15 tends to be longer as illustrated in FIG. 2. Hence, the time period $\beta$, i.e., from a timing when the paper 3 starts to be fed (t1) to a timing when the detection sensor 15 detects the paper 3 (t5), also becomes longer as shown in FIG. 6C. The pick-up roller 13 and the separation roller 14 therefore suspend operations for a time period $\alpha-\beta$ after the detection sensor 15 detects a leading edge of the paper 3, in accordance with the measured time period $\beta$. The pick-up roller 13 and the separation roller 14 then start operating again. In this case as well, as shown in FIG. 6C, the time interval between each successively conveyed sheet thus becomes $\alpha$.

In this way, according to the sheet supplying unit 4 of the present embodiment, when a trailing edge of a precedent sheet passed the detection sensor 15, supply of a subsequent sheet in the sheet tray 11 is configured to start. That is, the subsequent sheet starts to be supplied as promptly as possible.

Further, the pick-up roller 13 is configured to stop for the time period $\alpha$-$\beta$ after a leading edge of the subsequent sheet reaches the detection sensor 15, and is then configured to resume driving. Hence, the time interval between the precedent sheet and the subsequent sheet is adjusted to become $\alpha$ as derived from an equation $\beta+(\alpha-\beta)=\alpha$. In other words, even though duration from when sheet feeding has started until when the detection sensor 15 detects sheet passage may vary depending on variations in positions and amounts of sheets within the sheet tray 11, such deviations are allowed to be absorbed into a constant time interval $\alpha$. Each sheet of the paper 3 can be thus consecutively conveyed at the constant time interval $\alpha$. Accordingly, there is no need to establish a longish time interval on the premise of the variations in time intervals among each sheet, thereby enabling a shortest time interval to be set between each sheet. In this way, variations in time intervals between each sheet are suppressed, thereby leading to improved efficiency in sheet feeding operations.

Figure 6D:
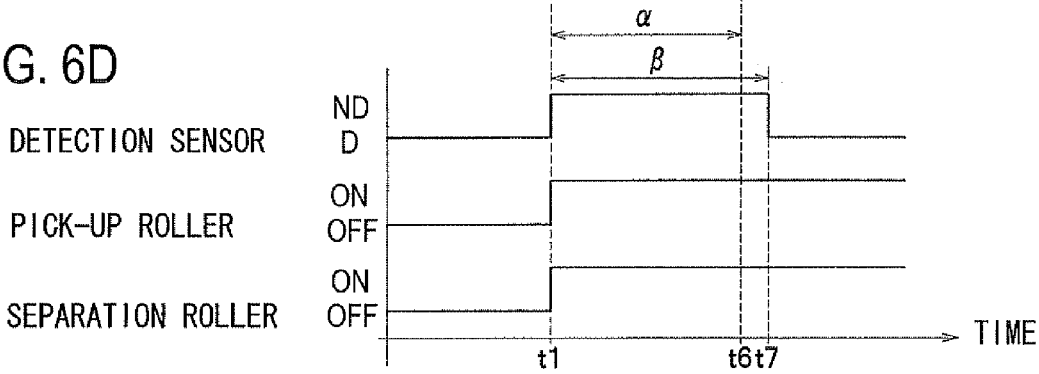
FIG. 6D is a time chart showing operational states of the detection sensor, the pick-up roller and the separation roller when last one sheet remains in the laser printer according to the present embodiment.

However, each sheet may not necessarily be supplied at the constant time interval $\alpha$. When the paper 3 in the sheet tray 11 becomes even fewer, for example, the time period $\alpha$ may be set to be smaller than the time interval $\beta$. In this case, as shown in FIG. 6D, the pick-up roller 13 and the separation roller 14 continue to feed the paper 3, once picking up, even after the detection sensor 15 detects a leading edge of a sheet of paper 3. With this configuration, when $\alpha$ is smaller than $\beta$, each sheet is successively supplied at the time interval $\beta$. That is, the time interval between each sheet cannot be a constant period of time like $\alpha$, but can be made shorter on average.

Additionally, in the present embodiment, the detection sensor 15 is provided at a position adjacent to the separation roller 14. Therefore, a constant time interval $\alpha$ (i.e., $\alpha>\beta$) can occupy greater percentage in the sheet supplying unit 4.

Further, because the sheet supplying unit 4 of the present embodiment employs the detection sensor 15 having a simple construction including the arm 15A and the optical sensor 15E, there may occur deviations in accuracy of timing at which the detection sensor 15 detects passage of the paper 3. However, the sheet supplying unit 4 of the present embodiment succeeds in suppressing such deviations by controlling timing at which the paper 3 is conveyed as described above, thereby improving efficiency in sheet supply.

Various modifications may be conceivable in the present invention. For example, in the present embodiment, the pick-up roller 13 is supported to the vertically movable roller supporting arm 13A so that the pick-up roller 13 can move in accordance with heights of an uppermost sheet of the paper 3 stacked in the sheet tray 11. The present invention can also be applied to a sheet supplying unit provided with a pressure plate for urging stacked sheets of paper upward in a sheet accommodation tray.

Figure 7:
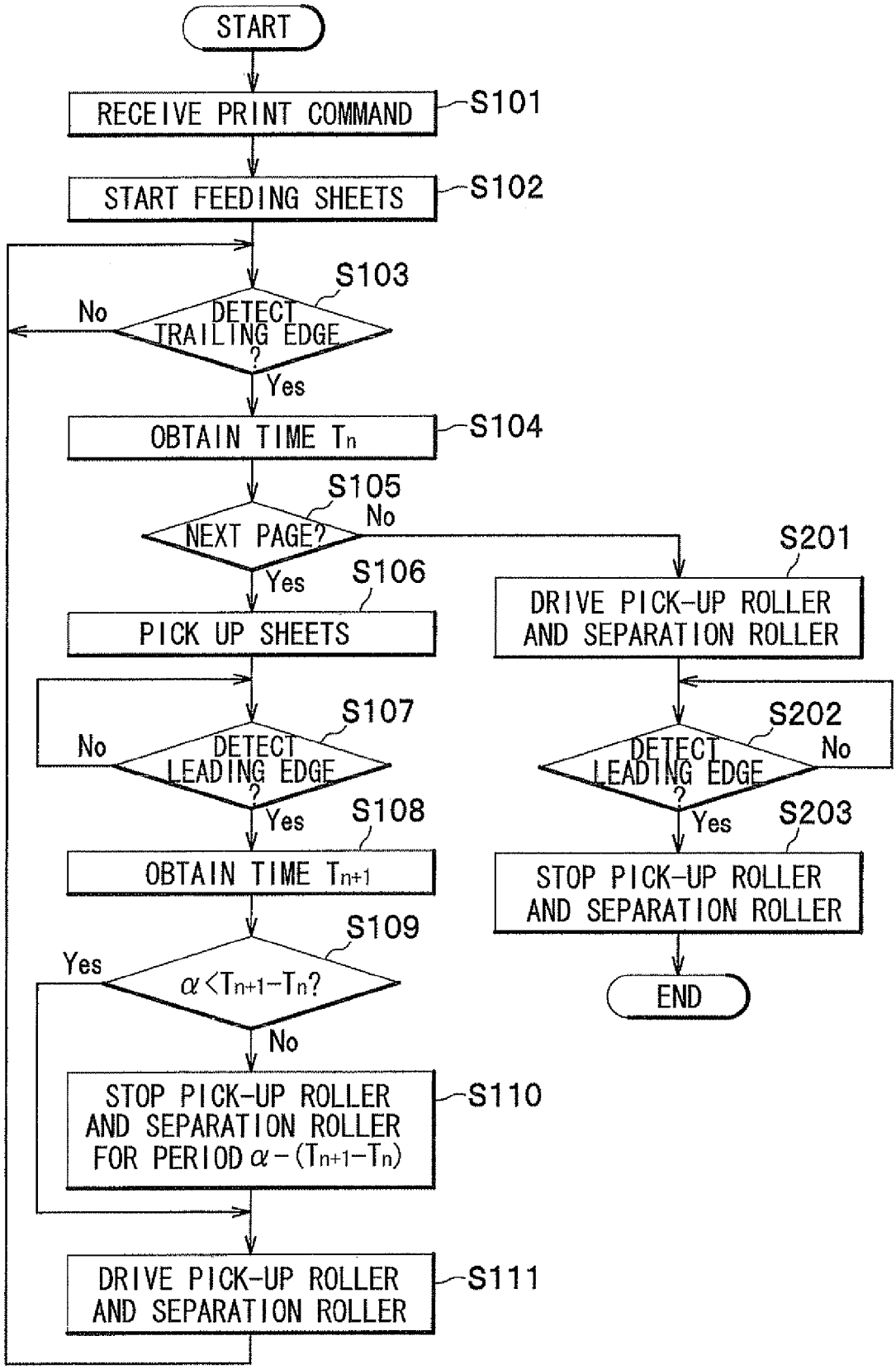
FIG. 7 is a flowchart of the sheet supply control routine executed by the control unit according to a modification to the control routine of FIG. 5.

As another variation, the control unit 100 may be configured to operate as shown in FIG. 7. Specifically, if there is no more page included in the print command (S105:No), the control unit 100 drives the pick-up roller 13 and the separation roller 14 (S201) and continues to drive the pick-up roller 13 and the separation roller 14 until the detection sensor 15 detects a leading edge of a next sheet of the paper 3 (S202). When the detection sensor 15 detects the leading edge of the next sheet (S202:Yes), the control unit 100 stops the pick-up roller 13 and the separation roller 14 (S203). In this way, the control unit 100 drives the pick-up roller 13 to convey a subsequent sheet after finishing supplying precedent sheets in response to a command to feed sheets, and stops driving the pick-up roller 13 when the detection sensor 15 detects a leading edge of the subsequent sheet. With this configuration, a first sheet of the paper 3 can be supplied immediately when the laser printer 1 starts printing operations next time.

Further, the sheet supplying unit 4 is applied to the laser printer 1 in the present embodiment, but the present invention can also be applied to another image forming device such an inkjet printer, a copier and a multifunctional device. Or alternatively, other than image forming devices, the present invention can also be applied to a device for supplying sheet-shaped materials in factories.

While the present invention has been described with respect to specific embodiments, it will be appreciated by one skilled in the art that a variety of changes may be made without departing from the scope of the invention.

What is claimed is:

1. A sheet supplying unit that supplies sheets comprising:

a sheet accommodation tray that accommodates the sheets in a stacked state, the sheets including a first sheet which is an uppermost sheet in the stack of the sheets and a second sheet which is immediately below the first sheet;

a pick-up roller that conveys the sheets in a sheet conveying direction;

a detection sensor that detects passage of the sheets and is disposed downstream of the pick-up roller in the sheet conveying direction; and a control unit that controls operations of the pick-up roller in accordance with outputs from the detection sensor, the control unit comprising:

a driving section that drives the pick-up roller to start conveying the second sheet concurrently with a time when the detection sensor detects a trailing edge of the first sheet and to continue to convey the second sheet until a time when the detection sensor detects a leading edge of the second sheet, if the second sheet is to be fed;

a suspending section that temporarily stops driving the pick-up roller to suspend conveying the second sheet for a time period $\alpha$-$\beta$ when the detection sensor detects the leading edge of the second sheet, a being a predetermined time period, and $\beta$ being a time period from the time when the detection sensor detects the trailing edge of the first sheet to the time when the detection sensor detects the leading edge of the second sheet; and a resuming section that resumes driving the pick-up roller to convey the second sheet after suspending for the time period $\alpha$-$\beta$.

2. The sheet supplying unit as claimed in claim 1, wherein the control unit further comprises a continuing section that continues to drive the pick-up roller to convey the second sheet without suspension when $\alpha$ is smaller than $\beta$.

3. The sheet supplying unit as claimed in claim 1, further comprising:

a separation roller that separates the sheets conveyed by the pick-up roller one by one, the detection sensor being disposed at a position adjacent to the separation roller.

4. The sheet supplying unit as claimed in claim 3, wherein the detection sensor is disposed downstream of the separation roller in the sheet conveying direction.

5. The sheet supplying unit as claimed in claim 1, wherein the detection sensor comprises:

a light emitting element that emits light;

a light receiving element that receives the light emitted from the light emitting element; and a pivot arm pivotally movable at a position between the light emitting element and the light receiving element for temporarily interrupting the light transmission from the light emitting element to the light receiving element in response to abutment with the sheets to the pivot arm.

6. The sheet supplying unit as claimed in claim 1, further comprising a supporting arm pivotally movable in a vertical direction, the pick-up roller being supported to the supporting arm, whereby the pick-up roller is vertically movable in conjunction with pivotal movements of the supporting arm in accordance with a vertical position of the first sheet accommodated in the sheet accommodation tray.

7. The sheet supplying unit as claimed in claim 1, wherein the control unit further comprises:

a conveying section that drives the pick-up roller to start conveying a third sheet which is subsequent to the second sheet if the second sheet is a final sheet to be fed; and an ending section that stops conveying the third sheet when the detection sensor detects the leading edge of the third sheet.

8. An image forming device comprising:

an image forming unit that forms images on sheets; and a sheet supplying unit that supplies the sheets to the image forming unit, the sheet supplying unit comprising:

a sheet accommodation tray that accommodates the sheets in a stacked state, the sheets including a first sheet which is an uppermost sheet in the stack of the sheets and a second sheet which is immediately below the first sheet;

a pick-up roller that conveys the sheets to the image forming unit in a sheet conveying direction;

a detection sensor that detects passage of the sheets and is disposed downstream of the pick-up roller in the sheet conveying direction; and a control unit that controls operations of the pick-up roller in accordance with outputs from the detection sensor, the control unit comprising:

a driving section that drives the pick-up roller to start conveying the second sheet concurrently with a time when the detection sensor detects a trailing edge of the first sheet and to continue to convey the second sheet until a time when the detection sensor detects a leading edge of the second sheet, if the second sheet is to be fed;

a suspending section that temporarily stops driving the pick-up roller to suspend conveying the second sheet for a time period $\alpha$-$\beta$ when the detection sensor detects the leading edge of the second sheet, $\alpha$ being a predetermined time period, and $\beta$ being a time period from the time when the detection sensor detects the trailing edge of the first sheet to the time when the detection sensor detects the leading edge of the second sheet; and a resuming section that resumes driving the pick-up roller to convey the second sheet after suspending for the time period $\alpha$-$\beta$.

9. A method of supplying sheets in a sheet supplying unit, the sheet supplying unit including a sheet accommodation tray that accommodates the sheets in a stacked state, the sheets including a first sheet which is an uppermost sheet in the stack of the sheets and a second sheet which is immediately below the first sheet; a pick-up roller that conveys the sheets in a sheet conveying direction; and a detection sensor that detects passage of the sheets and is disposed downstream of the pick-up roller in the sheet conveying direction, the method comprising:

driving the pick-up roller to start feeding the first sheet;

driving the pick-up roller to convey the second sheet concurrently with a time when the detection sensor detects a trailing edge of the first sheet and to continue to convey the second sheet until a time when the detection sensor detects a leading edge of the second sheet, if the second sheet is to be fed;

suspending driving the pick-up roller for a time period $\alpha$-$\beta$ when the detection sensor detects a leading edge of the second sheet, $\alpha$ being a predetermined time period, and $\beta$ being a time period from the time when the detection sensor detects the trailing edge of the first sheet to the time when the detection sensor detects the leading edge of the second sheet; and resuming driving the pick-up roller to convey the second sheet after suspending for the time period $\alpha$-$\beta$.

10. The method as claimed in claim 9, further comprising continuing to drive the pick-up roller to convey the second sheet without suspending for the time period $\alpha$-$\beta$ when $\alpha$ is smaller than $\beta$.

11. The method as claimed in claim 9, further comprising:

driving the pick-up roller to start conveying a third sheet which is subsequent to the second sheet if the second sheet is a final sheet to be fed (S201); and ending conveying the third sheet when the detection sensor detects the leading edge of the third sheet.

* * * * *